US009080264B2

(12) United States Patent
Bertolani

(10) Patent No.: US 9,080,264 B2
(45) Date of Patent: Jul. 14, 2015

(54) FABRIC MADE UP OF AT LEAST TWO LAPS INTERWOVEN ALONG A COMMON STRETCH AND METHOD FOR ITS PRODUCTION

(75) Inventor: Massimo Bertolani, Lucca (IT)

(73) Assignees: Loro Piana S.p.A., Quarona (IT); Antica Valserchio S.r.l., Castelnuovo, Garfagnana (IT)

( * ) Notice: Subject to any disclaimer, the term of this patent is extended or adjusted under 35 U.S.C. 154(b) by 0 days.

(21) Appl. No.: 12/867,473

(22) PCT Filed: Jul. 18, 2008

(86) PCT No.: PCT/EP2008/059000

§ 371 (c)(1),
(2), (4) Date: Aug. 12, 2010

(87) PCT Pub. No.: WO2009/100737

PCT Pub. Date: Aug. 20, 2009

(65) Prior Publication Data

US 2011/0005632 A1 Jan. 13, 2011

(30) Foreign Application Priority Data

Feb. 14, 2008 (IT) ..... TO2008A0112

(51) Int. Cl.
*D03D 23/00* (2006.01)
*D03D 27/00* (2006.01)
(Continued)

(52) U.S. Cl.
CPC ..... *D03D 11/02* (2013.01); *A41D 23/00* (2013.01); *D03D 3/02* (2013.01)

(58) Field of Classification Search
CPC ..... A41D 23/00; A41D 15/00; A41D 27/08; A41D 13/0512; A41D 15/04; A41D 31/0038; A41D 31/02; A41D 19/0017; A41D 1/22; A41D 27/00; A41D 3/08; A41D 1/00; A41D 2023/004; A41D 2400/424; A42B 1/041; A42B 1/004; A42B 1/006; A42B 1/067; A42B 1/16; D03D 11/02; D03D 1/00; D03D 3/02
USPC ..... 139/383 R, 387 R, 388, 390, 419, 383 B
See application file for complete search history.

(56) References Cited

U.S. PATENT DOCUMENTS 3,556,165 A * 1/1971 Jisa et al. ..... 139/383 R
3,711,627 A * 1/1973 Maringulov ..... 174/255
(Continued)

FOREIGN PATENT DOCUMENTS

DE 44 19 410 12/1995
DE 199 27 127 12/2000
(Continued)

OTHER PUBLICATIONS www.textileglossary.com/selvedge, Dec. 10, 2012.*

*Primary Examiner* — Bobby Muromoto, Jr.
(74) *Attorney, Agent, or Firm* — Merchant & Gould P.C.

(57) ABSTRACT

A fabric is made up of at least two laps (20, 21), each of which is formed by a series (22, 24) of longitudinal threads of yarn that are interwoven with one or more series (23, 25) of threads of yarn transverse to these. The first (20) and second laps (21) are joined along a common interweave stretch (30), respectively, parallel to the threads of warp yarn (22, 24) or parallel to the threads of weft yarn (23, 25) and in which the threads of weft yarn (23, 25) and of warp yarn (22, 24) of the two laps (20, 21) are interwoven. The common interweave stretch (30) extends laterally to the laps (20, 21) in such a way as to form a sort of third lap of width at least sufficient to guarantee the solidity of the join of the laps (20, 21) along the stretch of joining (30).

19 Claims, 8 Drawing Sheets

(51) Int. Cl.

| | |
|---|---|
| ***D03D 11/02*** | (2006.01) |
| ***D03D 3/02*** | (2006.01) |
| ***A41D 23/00*** | (2006.01) |
| *A41D 1/00* | (2006.01) |

(56) References Cited

U.S. PATENT DOCUMENTS

| | | | | | |
|---|---|---|---|---|---|
| 3,746,051 | A | * | 7/1973 | Mohelnicky et al. | 139/11 |
| 3,829,353 | A | | 8/1974 | Fisher | |
| 4,154,061 | A | * | 5/1979 | Umemoto et al. | 405/19 |
| 4,320,160 | A | * | 3/1982 | Nishimura et al. | 428/107 |
| 4,449,847 | A | * | 5/1984 | Scales et al. | 405/19 |
| 4,530,113 | A | * | 7/1985 | Matterson | 623/1.51 |
| 4,748,996 | A | * | 6/1988 | Combier | 139/415 |
| 4,816,028 | A | * | 3/1989 | Kapadia et al. | 623/1.52 |
| 5,014,755 | A | * | 5/1991 | Bompard et al. | 139/420 A |
| 5,040,572 | A | * | 8/1991 | Lindberg | 139/410 |
| 5,091,247 | A | * | 2/1992 | Willibey et al. | 442/46 |
| 5,143,569 | A | * | 9/1992 | Gotoh et al. | 156/148 |
| 5,273,080 | A | * | 12/1993 | Morohashi et al. | 139/388 |
| 5,657,795 | A | | 8/1997 | Sawko et al. | |
| 5,800,514 | A | * | 9/1998 | Nunez et al. | 623/1.51 |
| 5,904,714 | A | * | 5/1999 | Nunez et al. | 139/383 R |
| 6,302,044 | B1 | * | 10/2001 | Baudet | 114/102.33 |
| 6,733,211 | B1 | * | 5/2004 | Durie | 139/383 R |
| 6,739,159 | B2 | * | 5/2004 | Sciacca | 66/8 |
| 7,132,376 | B2 | * | 11/2006 | Rashed | 442/2 |
| 7,484,539 | B1 | * | 2/2009 | Huang | 139/384 R |
| 7,543,609 | B2 | * | 6/2009 | Sollars, Jr. | 139/389 |
| 2002/0050300 | A1 | * | 5/2002 | Wang | 139/388 |
| 2003/0131634 | A1 | * | 7/2003 | Sciacca | 66/64 |
| 2005/0011578 | A1 | * | 1/2005 | Walsh et al. | 139/383 R |
| 2007/0007756 | A1 | * | 1/2007 | Okuno et al. | 280/743.1 |
| 2009/0247034 | A1 | * | 10/2009 | Goering et al. | 442/206 |

FOREIGN PATENT DOCUMENTS

| | | |
|---|---|---|
| DE | 2003-147660 | 5/2003 |
| EP | 1 669 481 | 6/2006 |
| GB | 2 435 049 | 8/2007 |
| JP | 57-133241 | 8/1982 |
| JP | 8-33790 | 12/1996 |

* cited by examiner

FABRIC MADE UP OF AT LEAST TWO LAPS INTERWOVEN ALONG A COMMON STRETCH AND METHOD FOR ITS PRODUCTION

This application is a National Stage Application of PCT/EP2008/005900, filed 18 Jul. 2008, which claims benefit of Serial No. TO2008A000112, filed 14 Feb. 2008 in Italy and which applications are incorporated herein by reference. To the extent appropriate, a claim of priority is made to each of the above disclosed applications.

BACKGROUND

The subject of the present invention is a fabric made up of at least two laps interwoven along a common stretch, as well as the method for its production.

Fabrics with double width, which can be made only with shuttle looms, are used to make fabrics with a width twice what can normally be obtained with the reed width With said technique, two fabrics are obtained set on top of one another and joined together on one side; once it has come out of the loom, the fabric that is obtained hence has a width twice the reed width.

For production of the above fabric, as may be noted in FIG. 1, it is necessary to combine the weave of the fabric of the front with that of the back, both in the direction of the warp 11 and in the direction of the weft 10.

Weft insertion, in the case of a plain weave, will present the following sequence: the first weft insertion will interweave with the threads of warp yarn of the top fabric 12 (odd threads of yarn of the top fabric on top); the second weft insertion will interweave with the threads of warp yarn of the bottom fabric 13 (odd threads of yarn of the bottom fabric on top and lifting en masse of the threads of yarn of the top fabric), as likewise the third weft insertion (even threads of yarn of the bottom fabric on top and lifting en masse of the threads of yarn of the top fabric); and the fourth weft insertion will interweave with the threads of warp yarn of the top fabric (even threads of yarn of the top fabric on top).

By adopting the above logic, it is possible to obtain fabrics even of triple width 12, 13, 14 and 17, represented in FIG. 2 described below.

Tubular fabrics (illustrated in FIG. 3), which can also be made only with shuttle looms, are constituted by two fabrics 12 and 13 set on top of one another bound together only at the ends 17 through the two selvedges; they are in general used for making bags or sacks, or tubular fabric coatings.

Tubular fabrics differ from the double-width fabrics as regards the system of weft insertion, the sequence of which, in the case of a plain weave is as follows: the first weft will interweave with the threads of warp yarn of the top fabric (odd threads of yarn of the top fabric on top); the second weft with the threads of warp yarn of the bottom fabric (even threads of yarn of the bottom fabric on top and lifting en masse of the threads of yarn of the top fabric); the third weft will interweave with the threads of warp yarn of the top fabric (even threads of yarn of the top fabric on top); and the fourth weft will interweave with the threads of yarn of the bottom fabric (odd threads of yarn of the bottom fabric on top and lifting en masse of the threads of yarn of the top fabric).

If in a tubular fabric the threads of warp yarn and the threads of weft yarn alternate, as may be noted in FIG. 4, an alternating tubular fabric is obtained where the threads of warp yarn and threads of weft yarn that constitute the top fabric 12 and 13 exchange with one another on a longitudinal line 15, then coming to form the bottom fabric 13' and 12', as illustrated in FIG. 4.

By adopting the same logic, it is also possible to obtain alternating triple fabrics 12, 13, 16; 16', 12', 13'; 13", 16", 12", as illustrated in FIG. 5.

SUMMARY

The purpose of the present invention is to produce a fabric, formed by one or more series of longitudinal threads of yarn (warp) that interweave with one or more series of threads of yarn transverse to these (weft), which, by being constrained by one or more interweave stretches can come to form a product with three, four, or more laps of fabric that derive from said interweaves.

The interweave stretches and of mutual constraint of the various laps can be longitudinal or transverse.

The laps of fabric can be constituted by fabrics with plain weave or fabrics with complex weave and hence ones that can be produced using heddle looms or else jacquard looms.

The present invention stems from the fabrics of double or triple width and plain or alternating tubular fabrics. The originality of the invention lies in the fact that one or more interweave stretches are obtained that join together the various laps of the fabric, then rendering them variously separate from and independent of one another.

The above laps will moreover have the characteristic of presenting the longitudinal edges finished with tuck-in selvedge, true selvedge, or also a finish made with the leno motion device and/or hemming carried out in a subsequent step.

In order to achieve the above, as well as further purposes that will be understood more fully hereinafter, provided according to the invention are a fabric and a method for its production.

BRIEF DESCRIPTION OF THE DRAWINGS

The fabric according to the invention will now be described with reference to the attached plates of drawings, in which.

DETAILED DESCRIPTION

Albeit using the basic ideas of the types of fabric described above, in all the variables of weave, reductions, possible alternations, and number of laps of fabric, the characteristic feature of originality of the fabric according to the invention is that of having at least one longitudinal (not necessarily rectilinear) interweave stretch, around which the various laps of fabric are, at least on one side, free and independent of one another even though not ruled out is the possibility of them being variously constrained by interweaving also on transverse lines.

The so-called "interweave stretch" constitutes a constraint whereby the various laps of the fabric are kept together; the interweave stretch has, preferably but not exclusively, a longitudinal development, i.e., a development in the direction of the warp. For certain applications of the fabric, in fact, the interweave stretch can have a transverse development, i.e., a development in the direction of the weft, and in either case it can have a rectilinear or non-rectilinear development; a rectilinear stretch can be made both with heddle looms and with jacquard-type looms; non-rectilinear stretches must necessarily be made with jacquard-type looms.

The interweave stretch is made by interweaving the threads of warp yarn with the threads of weft yarn that make up the various laps of the fabric in order to enable them to be joined together; it can be more or less wide; i.e., it can involve a greater or smaller number of threads of warp yarn.

The number of interweave stretches that can be made may be variable, and there may be made on one and the same fabric a number n of stretches of a given dimension (width×length) and n stretches of another dimension (width×length).

Figure 1:
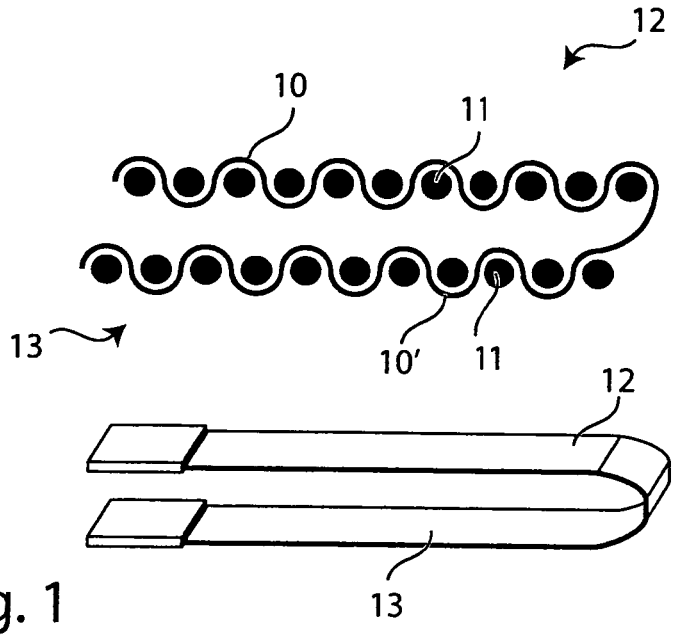
FIGS. 1-5 illustrate different embodiments of a fabric belonging to the state of the art; each figure represents the fabric in a schematic form and in the form of a web.
Figure 2:
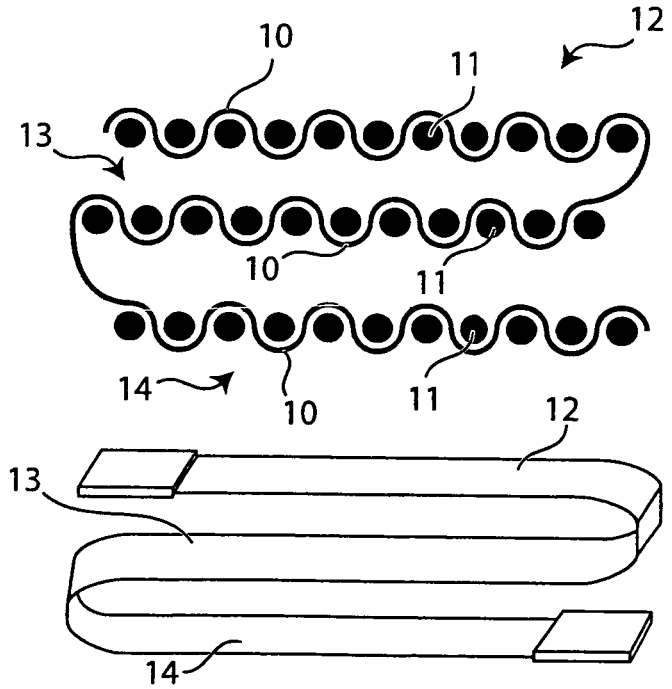
Figure 3:
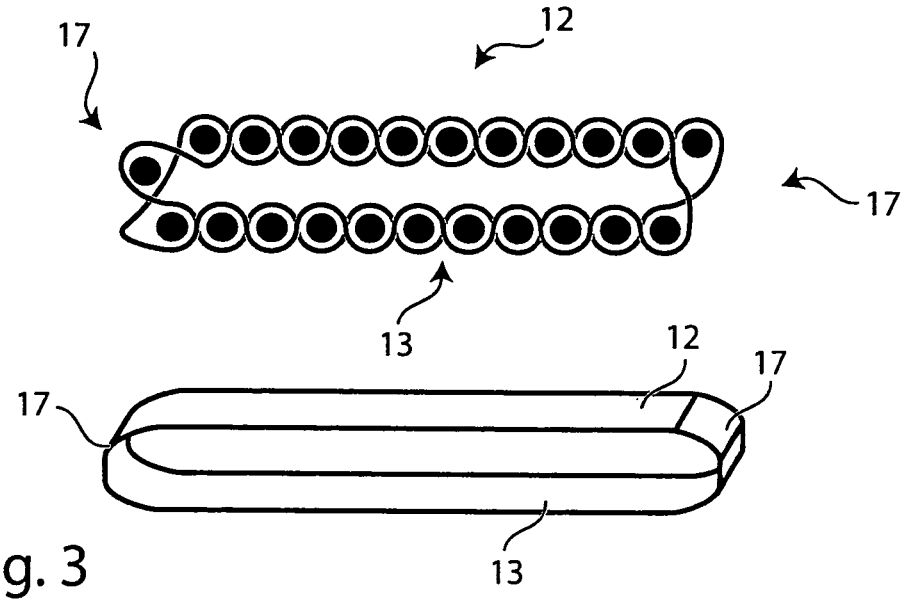
Figure 4:
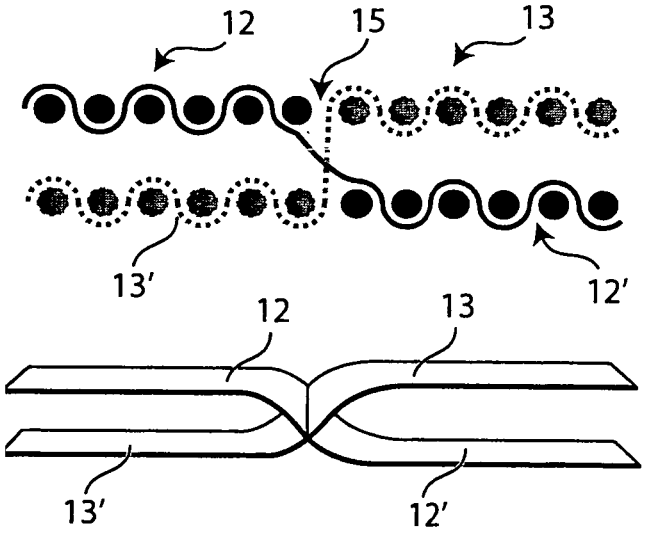
Figure 5:
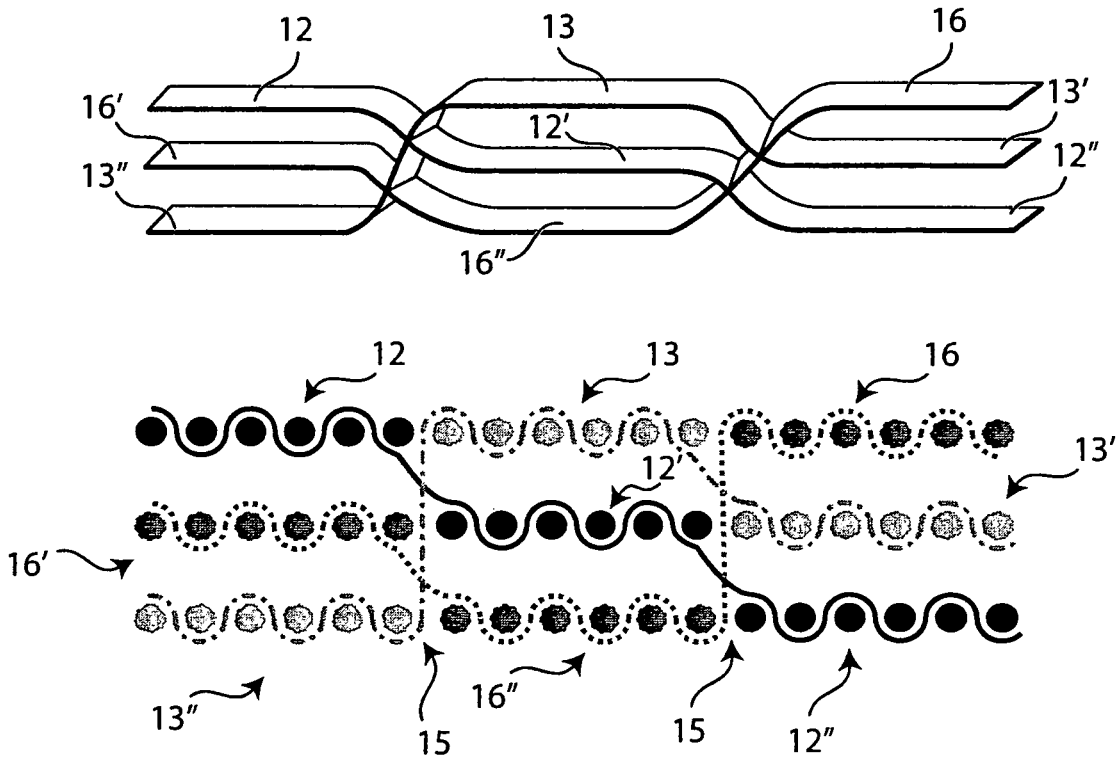
Figure 6:
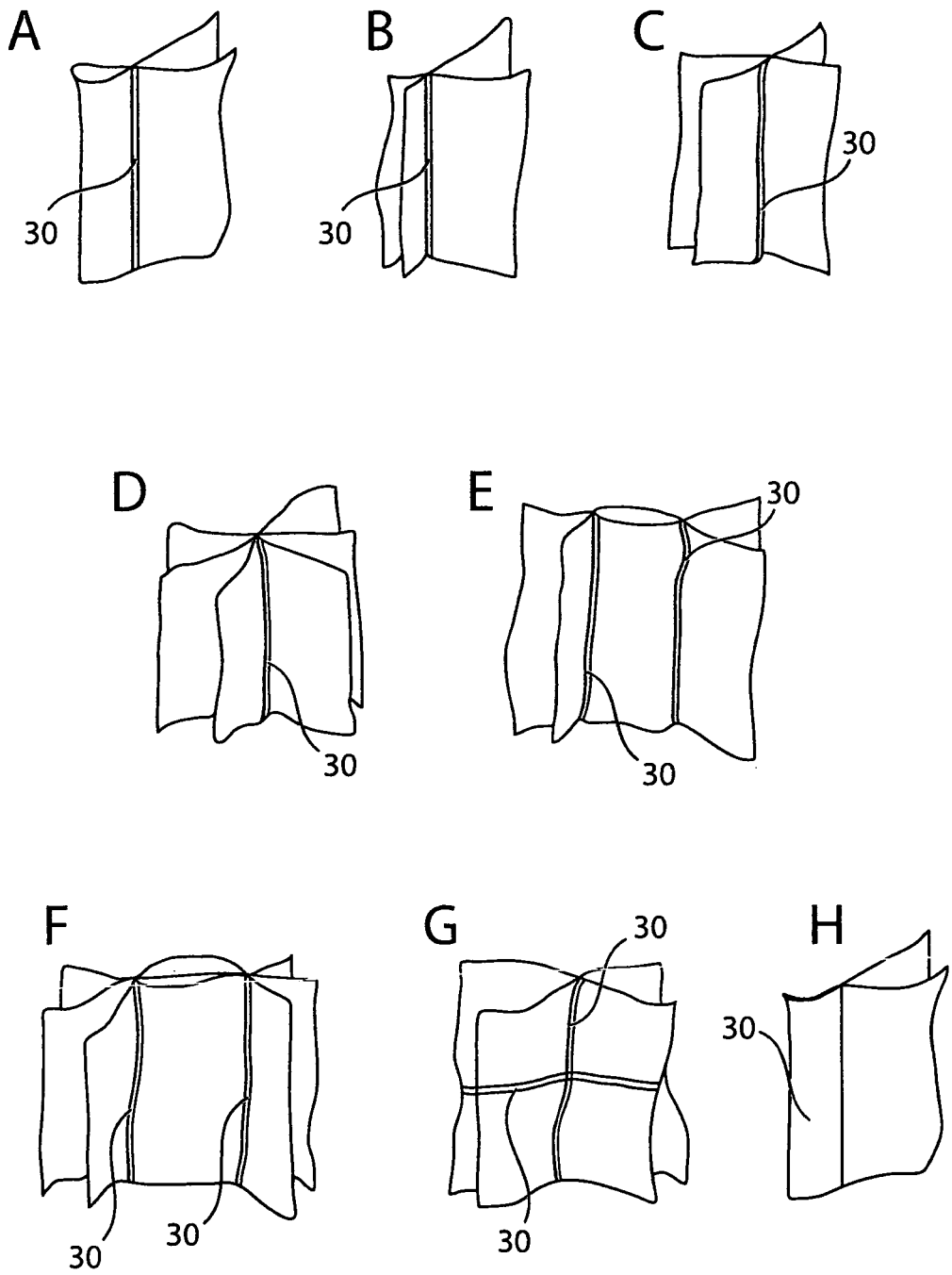
FIG. 6 is a schematic illustration of some embodiments of the fabric according to the invention.

Represented schematically in FIG. 6 are some examples of fabric made according to the invention; the interweave stretches are indicated, in all the embodiments except H, as thin bands 30, for reasons of simplicity of drawing, even though they necessarily have a certain plane extension such as to guarantee the secure joining of the various laps that constitute the product.

Illustrated, for example, in FIG. 6 are: a fabric A with four laps, two of which form a tubular fabric; a fabric B, like the fabric A, but with the tubular fabric cut longitudinally to form four laps; a fabric C with four laps; a fabric D with six laps; a fabric E with four laps and a central tubular fabric; a fabric F with six laps and a central transverse tubular fabric; a fabric G with eight laps in so far as it is divided by interweave stretches both in a longitudinal direction and in a transverse direction; and a fabric H with three laps. The embodiment H is the only one in which the interweave stretch 30 is very wide so that this also forms a lap of fabric, and hence the fabric has three laps.

For the production of the weave and of the common interweave stretch, either simple weaves or complex weaves can be used, including even weaves that can represent geometrical, ornate, or twilled patterns.

Conceptually similar to interweave stretches are also any possible transverse constraints, i.e., ones in a weft direction, that were to be made on the fabric, either in combination or not, with longitudinal stretches.

The fabric is made on traditional shuttle looms whether manual or mechanical, both on looms having different systems of weft insertion: rapier type, projectile type, gripper type, or jet type.

The looms of the two types can be understood as governed with heddle warp control, or by means of jacquard-type machines in the case where the production of operated (jacquard-type) fabrics is required.

It is also possible to make use of "slotted leno heald" bodies for the creation of gauze-type or gossamer fabrics.

The looms can be with a single warp beam or with a number of warp beams each provided with one or more pairs of flanges.

In the case of shuttle-less looms, tuck-in devices may be provided according to the number of individual widths of fabric to be produced simultaneously in the width of the loom, or else, in the case where it is desired to achieve a finish of the sides in a different way, leno motion devices may be used to enable n articles to be produced on the loom.

The threads of yarn that make up the warp of the fabric can be of various types, i.e., smooth or variously operated, with plain or fancy twill, of various titre and composition; they can be more or less in number according to the width and to the reductions per unit length of the fabric; and they can be either of a single type or in combination with one another.

They may be warped with reductions and shades of colour of any kind.

These threads of yarn will be put on the yarn beam in the desired width, being delimited by a pair of fringes.

The threads of yarn that constitute the weft of the fabric can be of various types, i.e., smooth or variously operated, with plain or fancy twill, of various titre and composition, and they can be of a single type or in combination with one another, the same as or different from the ones used for the warp.

They may be wefted with reductions and shades of colour of any kind.

For heddle looms, the drawing-in of the warp differs according to the type of fabric to be produced and to the maximum number of heddles allowed by the loom.

For jacquard-type looms, the passing could be traditional, but differentiated passings can also be envisaged according to the type of warp yarn to be used.

The looms may be provided either with single reeds or with double reeds having homogeneous or different reeding, as weft as with reeds of variable section according to the type of fabric to be produced.

There now follows a description, provided purely by way of example, of five types amongst the most specific for the production of as many fabrics according to the invention for the production of scarves. It is understood that, even though scarves are described as an application of the fabric, this does not imply any limitation to the possible applications of the fabric according to the invention.

This fabric, in fact, can find multiple applications in the sectors of clothing, of furnishing, of technical textiles and in any case in all the sectors in which fabrics are used that can advantageously present the characteristics of the fabric according to the invention.

Example 1

Scarf (see FIG. 7) with four laps, with the interweave stretch set centrally; for the four laps of fabric a plain weave is envisaged, whilst for the central stretch a weave of the Batavia 2/2 type is used.

The scarf is produced on a heddle loom of any width, which, if it is of the shuttle type, will necessarily have a width corresponding to that of the loom (single scarf), whereas, if it is produced on looms with a weft insertion of a different type from that of a shuttle loom, even a number of scarves could be made on the same loom width with the aid of pairs of tuck-in devices each provided for reinsertion of the stretch of weft cut. In the case where the scarf were to be made with fringes and/or lateral merrow edges, the tuck-in devices could be superfluous or not operative.

In the case of a plain weave to be made on the four laps and a Batavia weave to be made as weave of the central stretch, 8 heddles are necessary, plus the heddles for the selvedge; 4 heddles will be used for making the laps, the remaining 4 heddles for making the interweave stretch.

In the specific example, weaving will be carried out so as to produce a top fabric, which forms two laps 20 and 20' and is made up of threads of warp yarn 22 and threads of weft yarn 23, and a bottom fabric that forms laps 21 and 21' and is constituted by threads of warp yarn 24 and of weft yarn 25.

As may be noted, the threads of top weft yarn 23 interweave both with the threads of warp yarn 22 of the top fabric and with the threads of warp yarn 24 of the bottom fabric; likewise, the threads of weft yarn 25 of the bottom fabric interweave both with the threads of warp yarn 22 of the top fabric and with the threads of warp yarn 24 of the bottom fabric, in an area corresponding to a stretch 30, which can be more or less wide according to the needs, but which in any case determines an axis of hinge between the four laps of fabric that have been formed.

In the case where the intention were to make, on the four laps of the product, more complex weaves or particular evolutions or patterns of the central interweave stretch, a jacquard-type loom may be envisaged.

In the case where the product were to be made on shuttleless looms provided with tuck-in devices for reinsertion of the wefts cut at the two sides of the fabric, there should be envisaged an idle pick of the loom, without weft insertion for formation of the fabric, but with the operation of raising of the heddles, to enable reinsertion in the fabric of the end of weft cut by the tuck-in device in the previous pick.

Figure 7:
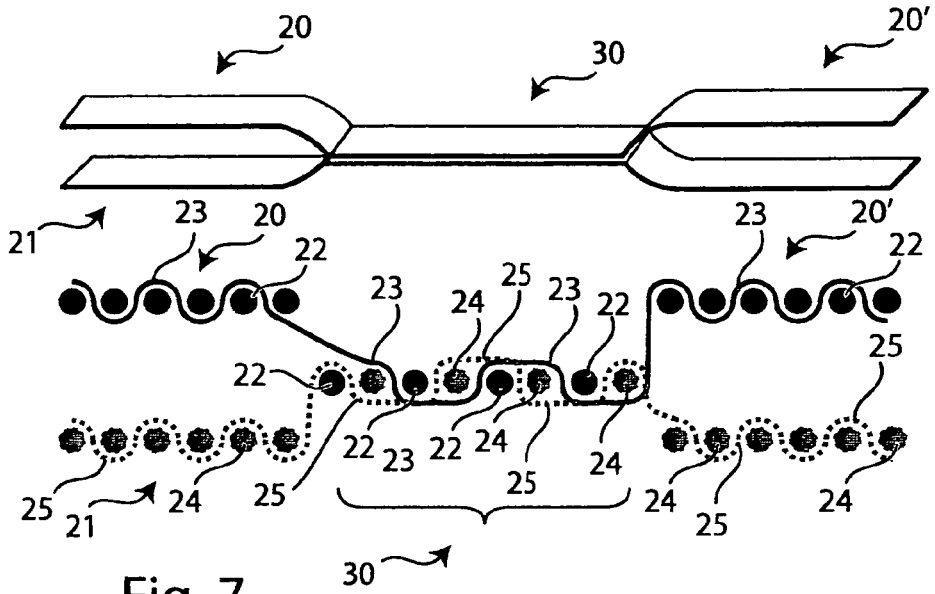
FIGS. 7, 8, 9, 10 and 11 illustrate the fabric according to the invention in some embodiments thereof in the same way as the fabrics according to the known art are illustrated in FIGS. 1-5.
Figure 7A:
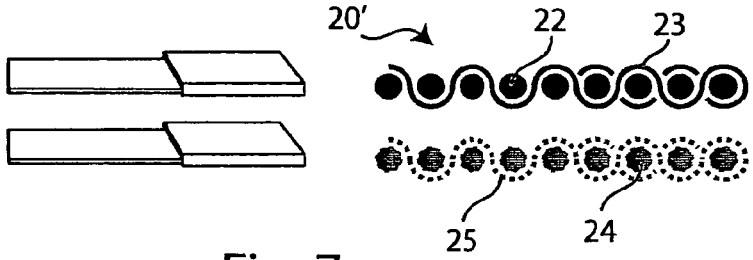
FIGS. 7*a*, 8*a*, 9*a* and 10*a* illustrate the tuck-in selvedges that can obtained in the respective embodiments.

FIG. 7*a* illustrates how the tuck-in selvedge is obtained according to this solution.

Example 2

Figure 8:
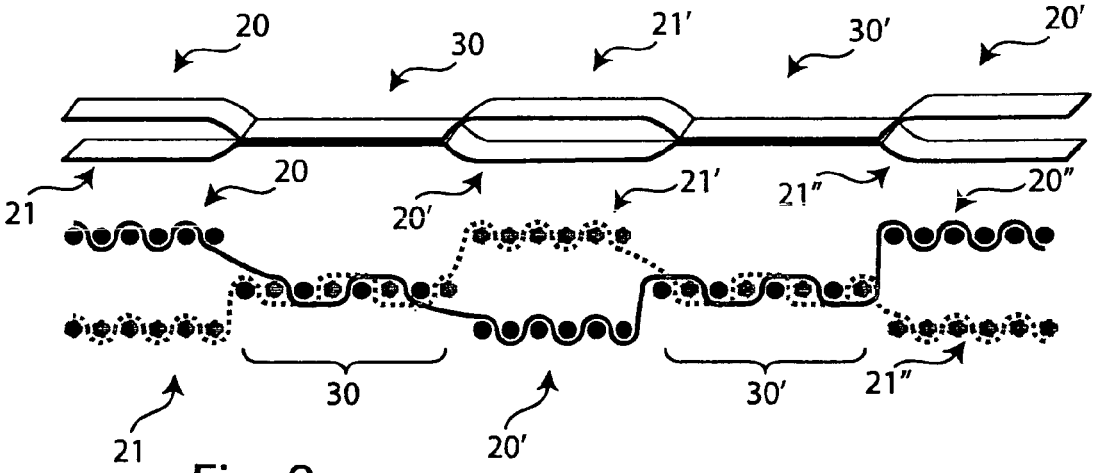

Scarf (see FIG. 8) with two stretches set centrally, the two stretches delimiting a central band of tubular fabric, whilst outside the two stretches there develop two respective laps of fabric. The laps develop in the scarf in alternating ways; namely: the top lap 20 on the left side, after the left-hand interweave stretch 30, passes onto the bottom side 20' centrally and, after the right-hand interweave stretch 30', passes again on the top side 20"; the other lap of fabric follows an opposite path: from the bottom left-hand side 21, after the first interweave stretch 30 it passes onto the top side 21' and, after the second interweave stretch 30', returns to the bottom side 21". For the laps of fabric 20, 20', 21, 21' a plain weave is envisaged, whereas for the two interweave stretches 30, 30' a Batavia 2/2 weave is envisaged.

The scarf will be woven on a heddle loom, of any width, which, if it is a shuttle loom, will necessarily have the width corresponding to that of the loom (single scarf). If the scarf is woven on looms with a type of weft insertion different from the shuttle weft insertion, even a number of scarves may be produced on the same loom width with the aid of pairs of tuck-in devices provided each for reinsertion of the stretch of weft cut. In the case where the scarf were to be made with fringes and/or lateral merrow edges, the tuck-in devices could be superfluous or not operative.

In the case of a plain weave to be performed on the two alternating faces, and a Batavia weave for the two axes, 12 heddles are necessary, plus the selvedge heddles; 4 heddles will be used for making the two axes and the other 8 heddles for making the two alternating fabrics.

In the case where the intention were to make, on the two (alternating) laps of the product, more complex weaves or particular evolutions or patterns of the axes, a jacquard-type loom may be envisaged.

In the case where the product were to be made on shuttleless looms provided with tuck-in devices for reinsertion of the wefts cut at the two sides of the fabric, there should be envisaged an idle pick of the loom, without weft insertion for formation of the fabric, but with the operation of raising of the heddles, to enable reinsertion in the fabric of the end of weft cut by the tuck-in device in the previous pick.

Figure 8A:
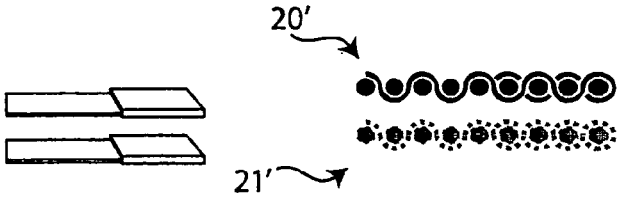

FIG. 8*a* illustrates how the tuck-in selvedge is obtained according to this solution.

Example 3

Figure 9:
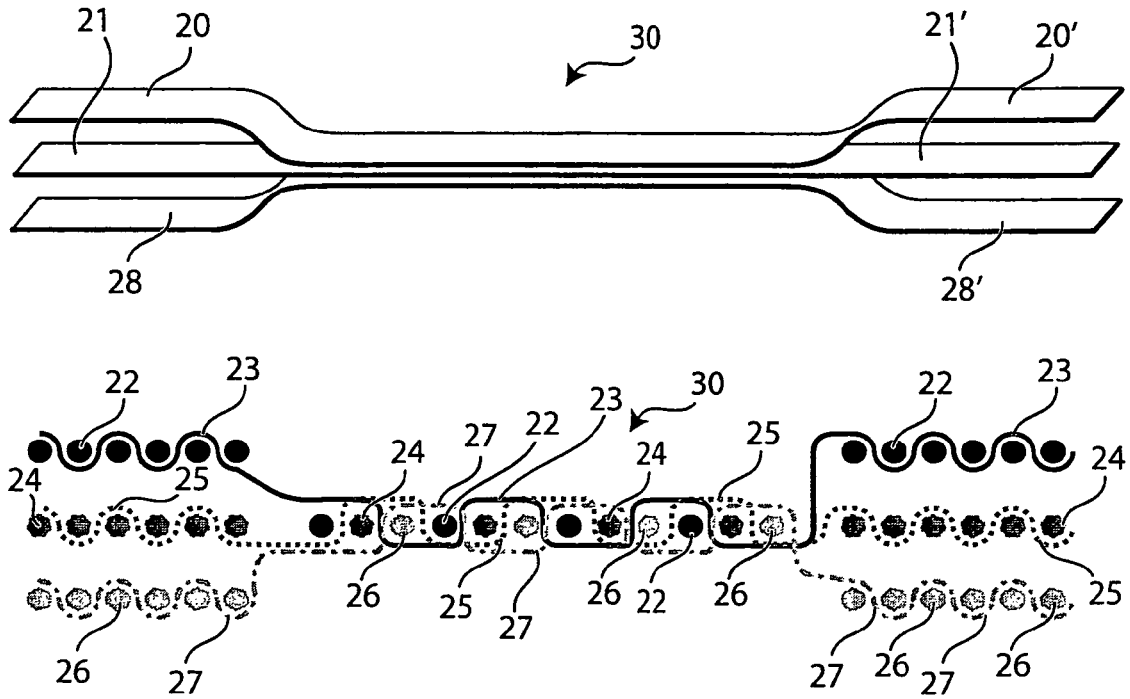

Scarf (see FIG. 9) with six laps with the interweave stretch set centrally; for the six laps of fabric a plain weave is envisaged; for the central stretch a weave of a Batavia 2/2 type is envisaged.

The scarf will be made on a heddle loom, of any width, which, if it is a shuttle loom, will necessarily have the width corresponding to that of the loom (single scarf). If the scarf is woven on looms with a type of weft insertion different from the shuttle weft insertion, even a number of scarves may be produced on the same loom width with the aid of pairs of tuck-in devices provided each for reinsertion of the stretch of weft cut. In the case where the scarf were to be made with fringes and/or lateral merrow edges, the tuck-in devices could be superfluous or not operative.

In the case of a plain weave to be performed on the six laps and a Batavia weave for the interweave stretch, 10 heddles are necessary, plus the selvedge heddles; 6 heddles will be used for making the laps, and the remaining 4 heddles for making the interweave stretch.

In the specific example, weaving will be performed to produce a top fabric, which forms two laps 20 and 20' and is constituted by threads of warp yarn 22 and of weft yarn 23, an intermediate fabric, which forms the laps 21 and 21' and is constituted by threads of warp yarn 24 and of weft yarn 25, and a bottom fabric, which forms the two laps 28 and 28' and is constituted by threads of warp yarn 26 and of weft yarn 27.

In this case, the threads of top weft yarn 23 are interwoven with: the threads of warp yarn 22 of the top fabric, the threads of warp yarn 24 of the intermediate fabric, and the threads of warp yarn 26 of the bottom fabric.

Likewise, also the threads of weft yarn 25 of the intermediate fabric and the threads of weft yarn 27 of the bottom fabric are interwoven with the three aforesaid sets of threads of warp yarn, 22, 24, 26, in an area corresponding to a central stretch 30, which can be more or less wide according to the needs, but which in any case determines an axis of hinge between the six laps of fabric that have been formed.

In the case where the intention were to make, on the six laps of the product, more complex weaves or particular evolutions or patterns of the axes, a jacquard-type loom may be envisaged.

In the case where the product were to be made on shuttleless looms provided with tuck-in devices for reinsertion of the wefts cut at the two sides of the fabric, there should be envisaged an idle pick of the loom, without weft insertion for formation of the fabric, but with the operation of raising of the heddles, to enable reinsertion in the fabric of the end of weft cut by the tuck-in device in the previous pick.

Figure 9A:
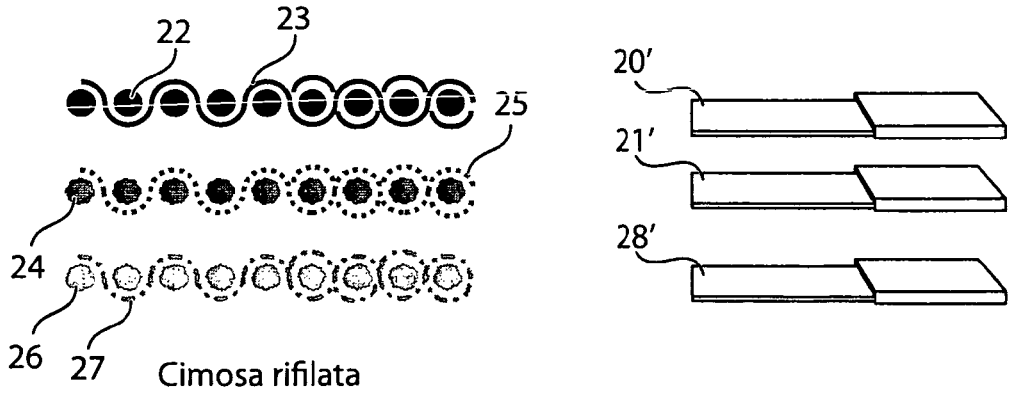

FIG. 9*a* illustrates how the tuck-in selvedge is obtained according to this solution.

Example 4

Scarf (see FIG. 10) with two laps with interweave stretch set laterally to define a third lap; for the two laps of fabric a plain weave is envisaged; for the lateral stretch a weave of a Batavia 2/2 type is envisaged.

The scarf will be made on a heddle loom of any width, which, if it is a shuttle loom, will necessarily have the width corresponding to that of the loom (single scarf). If the scarf is woven on looms with a type of weft insertion different from the shuttle weft insertion, even a number of scarves may be produced on the same loom width with the aid of pairs of tuck-in devices provided each for reinsertion of the stretch of weft cut. In the case where the scarf were to be made with fringes and/or lateral merrow edges, the tuck-in devices could be superfluous or not operative.

In the specific example, weaving will be performed to produce a top fabric, which forms one lap 20 and is constituted by threads of warp yarn 22 and of weft yarn 23, and a bottom fabric, which forms a lap 21 and is constituted by threads of warp yarn 24 and of weft yarn 25.

As in Example 1 illustrated with reference to FIG. 7, the threads of top weft yarn 23 are interwoven both with the threads of warp yarn 22 of the top fabric and with the threads of warp yarn 24 of the bottom fabric.

Likewise, also the threads of weft yarn 25 of the bottom fabric are interwoven both with the threads of warp yarn 22 of the top fabric and with the threads of warp yarn 24 of the bottom fabric in an area corresponding to a stretch 30, which in this case is sufficiently wide to provide a third lap 30 of any desired width.

In the case where the intention were to make, on the six laps of the product, more complex weaves or particular evolutions or patterns of the interweave stretch, a jacquard-type loom may be envisaged.

In the case where the product were to be made on shuttleless looms provided with tuck-in devices for reinsertion of the wefts cut at the two sides of the fabric, there should be envisaged an idle pick of the loom, without weft insertion for formation of the fabric, but with the operation of raising of the heddles, to enable reinsertion in the fabric of the end of weft cut by the tuck-in device in the previous pick.

Figure 10:
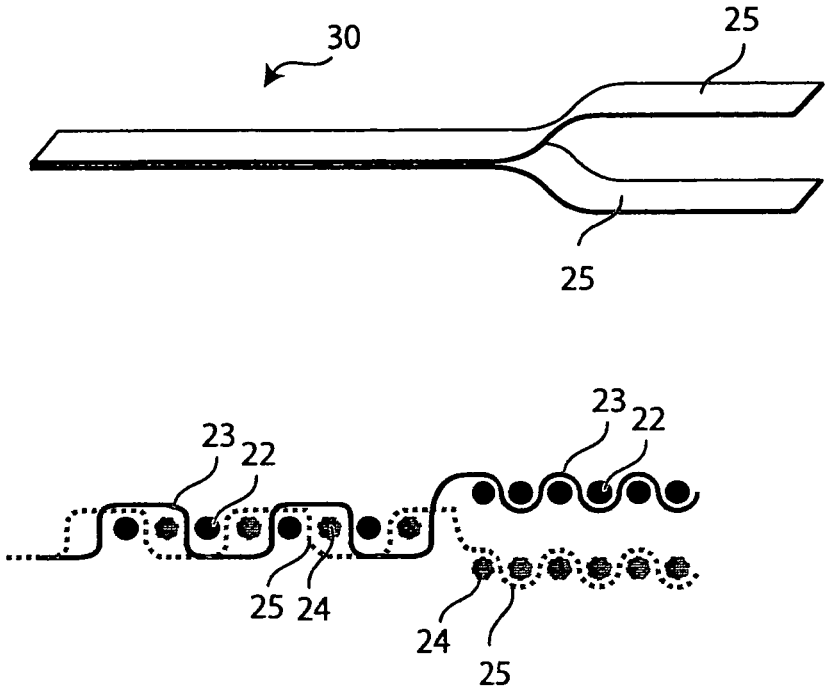
Figure 10A:
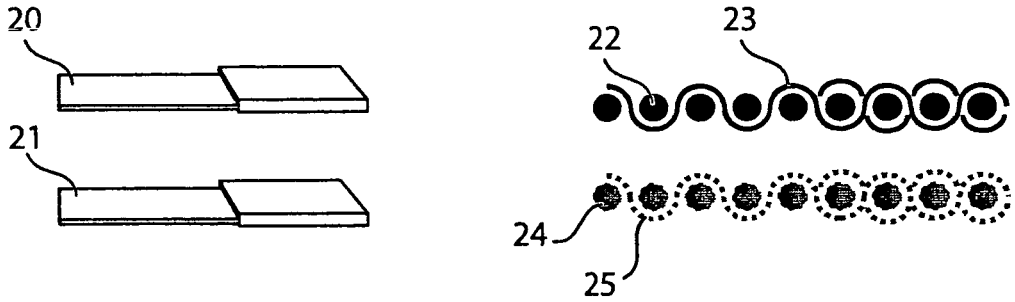

FIG. 10*a* illustrates how the tuck-in selvedge is obtained according to this solution.

Example 5

Figure 11:
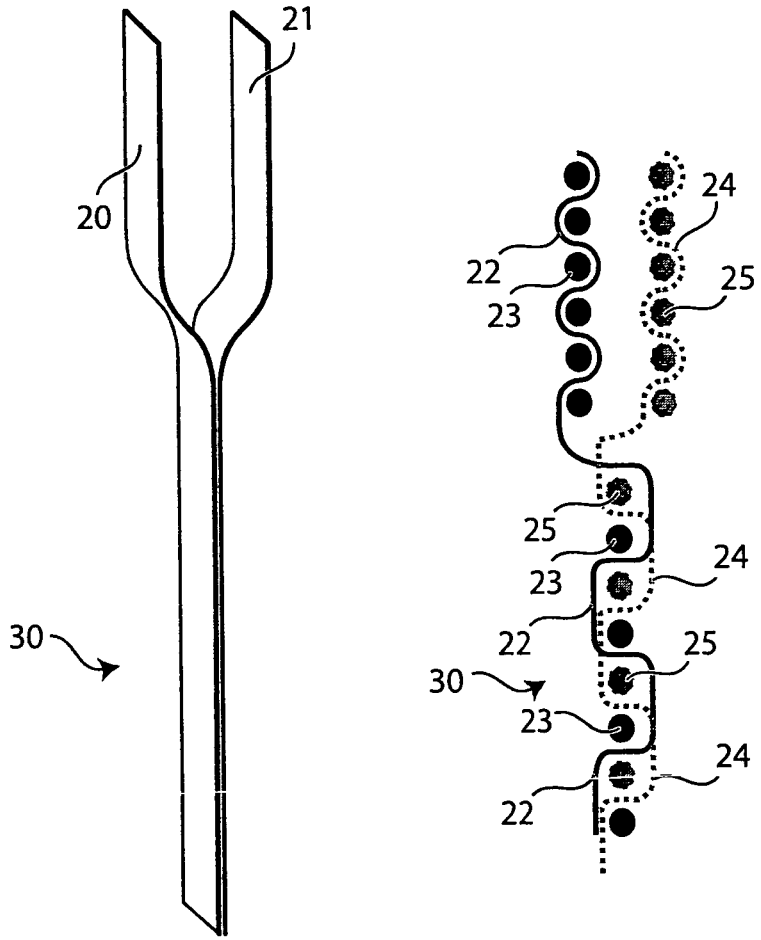

Fabric (see FIG. 11) with two laps, with interweave stretch set laterally to define a third lap.

The example shown is the case where the interweave stretch is made, not in a longitudinal direction, i.e., parallel to the threads of warp, but in a transverse direction, i.e., parallel to the threads of weft.

It is unnecessary to reproduce all the cases of the previous examples in the case of a transverse interweave stretch (the other examples regarded a longitudinal interweave stretch) in so far as from the drawings they would be obtained simply with a rotation of 90° in each case.

This example is comparable with Example 4 of FIG. 10, where there are two laps joined by an interweave stretch. In the specific example, the weave will be made so as to produce a fabric that forms one lap 20, made up of threads of warp yarn 22 and of weft yarn 23 and a lap 21, made up of threads of warp yarn 24 and of weft yarn 25.

As in Example 4, illustrated with reference to FIG. 10, in the lap 20 the threads of weft yarn 23 are interwoven with the threads of warp yarn 22; in the lap 21 the threads of weft yarn 25 are interwoven with the threads of warp yarn 24; in an area corresponding to the common interweave stretch, which also in this case is sufficiently wide as to provide a third lap 30 of any desired length, the two threads of weft yarn 23 and 25 are interwoven with both of the threads of warp yarn 22 and 24.

In the case where the intention were to make, on the six laps of the product, more complex weaves or particular evolutions or patterns of the interweave stretch, a jacquard-type loom may be envisaged.

In the case where the product were to be made on shuttleless looms provided with tuck-in devices for reinsertion of the wefts cut at the two sides of the fabric, there should be envisaged an idle pick of the loom, without weft insertion for formation of the fabric, but with the operation of raising of the heddles, to enable reinsertion in the fabric of the end of weft cut by the tuck-in device in the previous pick.

The invention claimed is:

1. A scarf or shawl having at least two fabric layers, including a first fabric layer and a second fabric layer, each of the fabric layers comprising a series of longitudinal threads of warp yarn interwoven with one or more series of threads of weft yarn transverse to the series of longitudinal threads, wherein the scarf or shawl has a width in the direction of the one or more series of threads of weft yarn, wherein said first fabric layer and said second fabric layer are joined along a common interweave having a length and a width, wherein the length of the common interweave is greater than the width of the common interweave, wherein the length of the common interweave is parallel to the threads of warp yarn, and the width of the common interweave is smaller than the width of the scarf or shawl, and wherein a plurality of threads of weft yarn and a plurality of threads of warp yarn of the first fabric layer are interwoven with a plurality of threads of weft yarn and a plurality of threads of warp yarn of the second fabric layer in the common interweave; wherein said common interweave forms a third fabric layer joining the first fabric layer and the second fabric layer along said common interweave; and wherein free ends of each of the first fabric layer and the second fabric layer are finished by a rethreaded and retracted selvedge.

2. The scarf or shawl according to claim 1, wherein the scarf or shawl comprises a first common interweave and a second common interweave, perpendicular to one another, each common interweave having a length and a width, the length being greater than the width, wherein the length of the first common interweave is parallel to the threads of warp yarn and the length of the second common interweave is transverse to the threads of warp yarn.

3. The scarf or shawl according to claim 1, wherein the two fabric layers extend beyond the common interweave to form a tubular fabric element.

4. The scarf or shawl according to claim 1, wherein the common interweave that joins the two fabric layers is of a width sufficient to form the third fabric layer.

5. The scarf or shawl according to claim 1, wherein the scarf or shawl comprises six fabric layers divided into in two groups of three, each group joined by the common interweave.

6. The scarf or shawl according to claim 1, comprising a plurality of common interweave stretches.

7. A method for the production of a scarf or shawl comprising a first layer of fabric and a second layer of fabric, each of the first fabric layer and the second fabric layer is formed by threads of longitudinal warp yarn that are interwoven with threads of transverse weft yarn, said method comprising:

producing two layers of fabric set on top of one another;

at the same time, forming a common interweave to join the layers of fabric along the common interweave, by interweaving a plurality of threads of warp yarn of the first layer of fabric and a plurality of the threads of warp yarn of the second layer with a plurality of threads of weft yarn of the first layer and a plurality of threads of weft yarn of the second layer, wherein the common interweave has a width and a length, the length of the common interweave being greater than the width of the common interweave, and the width of the common interweave being smaller than a width of the scarf or shawl, wherein the length of the common interweave is aligned with the threads of warp yarn; and creating a selvedge by rethreading and inserting cut wefts on free edges of each of the layers of fabric.

8. The scarf or shawl according to claim 1, wherein the first fabric layer forms a top layer and the second fabric layer forms a bottom layer, and wherein yarns of the warp yarn of the first fabric layer extend within the top layer on either side of the common interweave.

9. The scarf or shawl according to claim 8, wherein yarns of the warp yarn of the second fabric layer extend within the bottom layer on either side of the common interweave.

10. A multilayered fabric, wherein the multilayered fabric defines a warp direction parallel to warp threads and a weft direction parallel to weft threads and perpendicular to the warp direction, and a length aligned in the warp direction and a width aligned in the weft direction, the multilayered fabric comprising:

a) a first layer comprising a first series of warp threads aligned in the warp direction and a first series of weft threads aligned in the weft direction;

b) a second layer comprising a second series of warp threads aligned in the warp direction and a second series of weft threads aligned in the weft direction; and c) a first elongated interwoven section having a length aligned in the warp direction and a width aligned in the weft direction, wherein in the elongated interwoven section a portion of the first series of warp threads and a portion of the second series of warp threads are aligned in a single plane, and threads of the first series of weft threads and the second series of weft threads are interwoven with each of the portions of warp threads, wherein the width of the first elongated interwoven section is smaller than the width of the multilayered fabric, and wherein the first layer and the second layer extend on both sides of the elongated interwoven section in the weft direction.

11. The multilayered fabric of claim 10, wherein the width of the elongated interwoven section is equal to a width of a plurality of warp threads.

12. The multilayered fabric of claim 10 comprising two or more elongated interwoven sections aligned in the warp direction, wherein any two elongated sections are spaced apart by a section of the first layer and a section of the second layer.

13. The multilayered fabric of claim 10 comprising two or more elongated interwoven sections aligned in the warp direction, wherein two adjacent elongated sections and the first and second layers between the two adjacent elongated sections define a tubular fabric having a hollow center aligned in the warp direction.

14. The multilayered fabric of claim 10 further comprising at least one intersecting interwoven section not aligned in the warp direction, wherein the at least one crossing interwoven section intersects with at least one elongated interwoven section.

15. The multilayered fabric of claim 14, wherein the intersecting interwoven section is aligned in the weft direction.

16. The multilayered fabric of claim 15, wherein the intersecting interwoven section is non-rectilinear.

17. The multilayered fabric of claim 10 further comprising a third layer comprising a third series of warp threads aligned in the warp direction and a third series of weft threads aligned in the weft direction, wherein in the elongated interwoven section a portion of the first, second, and third series of warp threads are aligned in a single plane, and threads of the first, second, and third series of weft threads are interwoven with each of the portions of warp threads.

18. The multilayered fabric of claim 10, wherein the first and second layer have free ends parallel to the warp direction, the free ends finished by a rethreaded and retracted selvedge.

19. The multilayered fabric of claim 10, wherein the first and second layers are connected along at least one side forming a tubular fabric between the first and second layers and the elongated interwoven section, the tubular fabric having a hollow center aligned in the warp direction.

* * * * *